US008348754B2

(12) United States Patent
Jackson et al.

(10) Patent No.: US 8,348,754 B2
(45) **Date of Patent: *Jan. 8, 2013**

(54) SLOT MACHINE HAVING MULTIPLE PROGRESSIVE JACKPOTS

(75) Inventors: James P. Jackson, Henderson, NV (US); Robert J. Piechowiak, Las Vegas, NV (US)

(73) Assignee: Multimedia Games, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,548

(22) Filed: Mar. 5, 2012

(65) Prior Publication Data

US 2012/0172109 A1 Jul. 5, 2012

Related U.S. Application Data

(63) Continuation of application No. 12/358,876, filed on Jan. 23, 2009, now Pat. No. 8,128,489, which is a continuation of application No. 09/499,592, filed on Feb. 7, 2000, now Pat. No. 7,481,430.

(51) Int. Cl.
*A63F 1/00* (2006.01)

(52) U.S. Cl. ..... 463/25; 273/138.1

(58) Field of Classification Search ..... 463/25–28; 273/138.1, 139; 700/91–93
See application file for complete search history.

(56) References Cited

U.S. PATENT DOCUMENTS

| | | | |
|---|---|---|---|
| 4,861,041 | A | 8/1989 | Jones et al. |
| 4,948,134 | A | 8/1990 | Suttle et al. |
| 5,048,833 | A | 9/1991 | Lamle |
| 5,249,800 | A | 10/1993 | Hilgendorf et al. |
| 5,263,716 | A | 11/1993 | Smyth |
| 5,275,400 | A | 1/1994 | Weingardt et al. |
| 5,280,909 | A | 1/1994 | Tracy |
| 5,282,620 | A | 2/1994 | Keesee |
| 5,286,023 | A | 2/1994 | Wood |
| 5,344,144 | A | 9/1994 | Canon |
| 5,393,061 | A | 2/1995 | Manship et al. |
| 5,472,194 | A | 12/1995 | Breeding et al. |
| 5,564,700 | A | 10/1996 | Celona |
| 5,580,053 | A | 12/1996 | Crouch |
| 5,626,341 | A | 5/1997 | Jones et al. |
| 5,788,573 | A | 8/1998 | Baerlocher et al. |
| 5,795,225 | A | 8/1998 | Jones et al. |
| 5,807,172 | A | 9/1998 | Piechowiak |
| 5,851,147 | A | 12/1998 | Stupak et al. |
| 5,855,515 | A | 1/1999 | Pease et al. |

(Continued)

OTHER PUBLICATIONS

Slot Machine called "Money Money," by Sigma Game, Inc., 1996.

(Continued)

*Primary Examiner* — Dmitry Suhol
*Assistant Examiner* — Alex F. R. P. Rada, II
(74) *Attorney, Agent, or Firm* — Russell D. Culbertson, Esq.; Nathan H. Calvert, Esq.; J P Cody

(57) ABSTRACT

A progressive jackpot slot machine, or group of slot machines, is described herein. A plurality of progressive jackpots are accumulated as the slot machine is played. In one preferred embodiment, a first progressive jackpot is accumulated at a first rate, and a second progressive jackpot is accumulated at a rate higher than the first rate. Additional jackpots accumulate at higher rates. The betting of additional monetary amounts enables the player to win additional jackpots. This provides added incentive for the player to bet additional monetary amounts.

16 Claims, 7 Drawing Sheets

U.S. PATENT DOCUMENTS

| | | | | |
|---|---|---|---|---|
| 5,868,619 | A | 2/1999 | Wood et al. | |
| 5,951,011 | A | 9/1999 | Potter et al. | |
| 6,015,347 | A | 1/2000 | Maahs et al. | |
| 6,017,032 | A | 1/2000 | Grippo et al. | |
| 6,117,012 | A | 9/2000 | McCrea, Jr. | |
| 6,155,925 | A | 12/2000 | Giobbi et al. | |
| 6,210,275 | B1 | 4/2001 | Olsen | |
| 6,220,596 | B1 | 4/2001 | Horan | |
| 6,224,484 | B1 | 5/2001 | Okuda et al. | |
| 6,402,150 | B1 | 6/2002 | Jones | |
| 7,481,430 | B1 * | 1/2009 | Jackson et al. | 273/138.1 |
| 8,128,489 | B2 * | 3/2012 | Jackson et al. | 463/25 |

OTHER PUBLICATIONS

Fey, "Slot Machines, A Pictorial History of the First 100 Years," 5th Ed., 1997, showing the Bally model '889 slot machine, p. 208.

Fey, "Slot Machines, A Pictorial History of the First 100 Years," 5th Ed., 1997, showing the "MegaBucks" slot machine by IGT, p. 212.

Indian Gaming, "IGT-ON a Progressive Game Roll," Dec. 1998, showing the "QuarterMania" slot machine by IGT, p. 37.

Slot Manager, "Making Poker Pay," Jan. 1999 showing "PokerMania" slot machine by IGT, p. 14.

Slot Manager, "New Slot Strategies Pay Off," Apr. 1998, p. 10.

Slot Manager, "Space Considerations," Jul. 1997, pp. 31-32.

Casino Journal, "Slot Wars, Will Interactive Technology Change the Face of Gaming?", Jun. 1996, p. 42.

Casino Executive, "The Ultimate Slot Floor," Jan. 1999, pp. 33-34.

Casino Executive, "Poker Plus," Jun. 1998, p. 61.

Casino Player, "Loosest Slots Awards 1999," Apr. 1999, p. 52.

* cited by examiner

SLOT MACHINE HAVING MULTIPLE PROGRESSIVE JACKPOTS

CROSS-REFERENCE TO RELATED APPLICATION

This application is a continuation of U.S. patent application Ser. No. 12/358,876 filed Jan. 23, 2009 and entitled "SLOT MACHINE HAVING MULTIPLE PROGRESSIVE JACKPOTS," now U.S. Pat. No. 8,128,489, which is a continuation of U.S. patent application Ser. No. 09/499,592 filed Feb. 7, 2000 and entitled "SLOT MACHINE HAVING MULTIPLE PROGRESSIVE JACKPOTS," now U.S. Pat. No. 7,481,430. The benefit of these two prior nonprovisional applications is hereby claimed in the present application pursuant under 35 U.S.C. §120. The entire content of each of the above-identified U.S. patent applications is incorporated herein by this reference.

FIELD OF THE INVENTION

This invention relates to gaming machines, such as slot machines, and in particular to a progressive jackpot feature on such gaming machines.

BACKGROUND OF THE INVENTION

Slot machines having progressive jackpots are well known. Examples of such machines are found in U.S. Pat. Nos. 5,048,833, 5,249,800, and 5,280,909, incorporated herein by reference. In existing devices, a small percentage of each amount bet in either one machine or a group of machines is allocated to a progressive jackpot. A special symbol combination is designated as the progressive jackpot winner. When this jackpot symbol combination is obtained by a slot machine, the progressive jackpot is awarded to that player, and the jackpot is reset to an initial amount. The initial amount may be zero or any other predetermined amount. In such machines, there is typically only one progressive jackpot.

Slot machines which generate higher revenues for the machine owner are more valuable to the machine owner. Thus, any feature that makes a slot machine more enticing to a player and causes the player to deposit more money into the machine is desirable.

SUMMARY OF THE INVENTION

A progressive jackpot slot machine, or a group of slot machines, is described herein, where multiple progressive jackpots may be won. In one embodiment, a single coin bet on a game entitles the player to win a first progressive jackpot if a special symbol combination is obtained by the machine. If the player chooses to deposit two coins for a single game, the player can then win a second progressive jackpot. This second progressive jackpot may be in addition to the first progressive jackpot. If the player deposits three coins for a single game, the player has an opportunity to win a third progressive jackpot, or the total amount of the first, second, and third progressive jackpots. The invention envisions any number of progressive jackpots and any required monetary amounts to qualify for the various jackpots.

In one embodiment, the first progressive jackpot is built upon allocating 0.5% of all bets wagered in the various machines in the group. The second progressive jackpot allocates 1% of all the bets wagered, and the third progressive jackpot allocates 2% of all the bets wagered. This concept may be applied to other percentages such that the second progressive jackpot is larger than the first progressive jackpot, and the third progressive jackpot is larger than the second progressive jackpot. In this manner, the player has a further incentive to play the maximum number of coins to win the largest jackpot.

This concept may be applied to single slot machines or slot machines within a group. This concept may also be applied to single payline slot machines, 3-payline slot machines, or other types of slot machines, such as 9-payline slot machines.

DESCRIPTION OF ILLUSTRATIVE EMBODIMENTS

Figure 1:
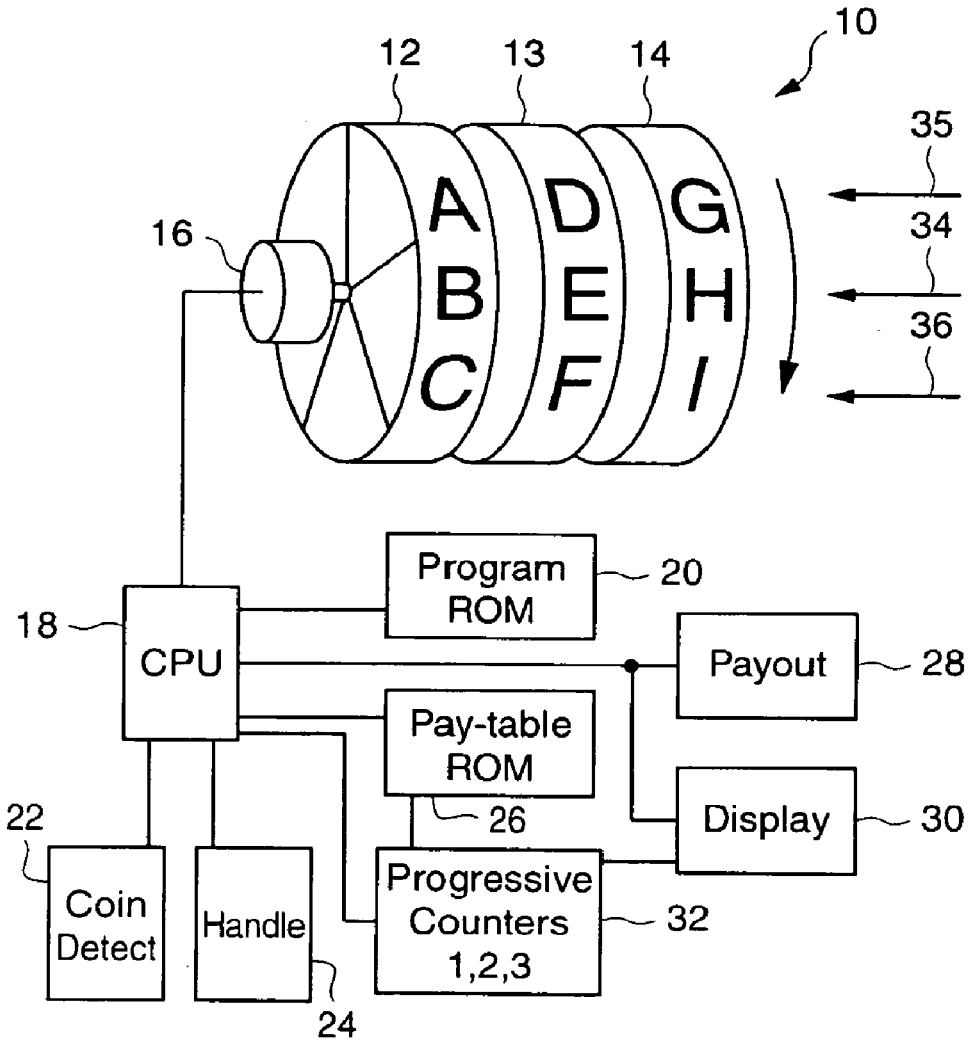
FIG. 1 illustrates the functional components of a mechanical reel-type slot machine incorporating the multiple progressive jackpot feature.

FIG. 1 illustrates the primary functional units in a slot machine in accordance with one embodiment of the invention. In slot machine 10, each of the reels 12, 13, and 14 has a variety of symbols printed on its periphery. Each of the reels 12-14 is driven by a separate stepper motor 16 which rotates in response to pulses from a CPU 18. When the pulses to a stepper motor 16 are terminated, the reel stops abruptly.

In one embodiment, the stopping positions of the reels 12-14 are predetermined using a random number generator consisting of a random number generator program in the program ROM 20 carried out by the CPU 18. The required number of pulses to the three stepper motors after a zero position of each reel are then generated to display the predetermined symbol combination. In another embodiment, each of the reels has tabs that are sensed by a photodetector to determine the angular displacement of the reel and thus the final displayed symbol. Other means for detecting the positions of the reels exist and are well known.

A money detector 22, which may detect coins or other currency, issues a command to the CPU 18 that the slot machine 10 is ready to be played. The player may then pull a handle 24 or press a button to initiate play.

After the reels have stopped, the CPU 18 conveys the stop positions to a pay-table ROM 26, which cross-references the final displayed symbols with a monetary payout to the player. This payout is then conveyed to a payout mechanism 28 which issues coins or credits to the player. A display 30 may also be activated, signaling a win to the player.

The above general description of a modern slot machine would be well known in the art, and such a programmable machine offers great advantages. Slot machines are varied by simply changing the operating program in the program ROM 20 and the award program in the pay-table ROM 26. The front glass of the slot machine is also changeable to convey particular features of the machine.

Examples of such conventional portions of slot machines are found in U.S. Pat. No. 4,095,795 to Saxton et al., U.S. Pat. No. 4,448,419 to Telnaes, and U.S. Pat. No. 4,573,681 to Okada, all incorporated herein by reference.

In addition to conventional portions of a slot machine, the slot machine in accordance with the present invention includes circuitry, or a program, that generates multiple progressive jackpots that may be won by the player. In one embodiment, there are three different progressive jackpots, each jackpot being accumulated at a different rate. This jackpot circuitry is designated as circuitry 32 in FIG. 1. Each of the jackpots is displayed on display 30, which may be a display in the slot machine itself or a public display viewable by anyone playing a slot machine connected in a group such that any slot machine in the group which achieves the particular jackpot combination receives the designated jackpot displayed.

In one embodiment, each of the jackpots is based upon allocating a percentage of each amount bet by the players of the group of slot machines or, in the case of an individual slot machine incorporating the invented feature, a percentage of the money deposited into that individual slot machine. Such an accumulation of the progressive jackpots may be by counting the monetary units deposited into the slot machines and performing simple mathematical calculations to obtain the amounts to be added to the various jackpots. In one embodiment, modulo X counters count the monetary units bet, and the respective jackpot is only incremented upon each zero detection of the counter.

Figure 2:
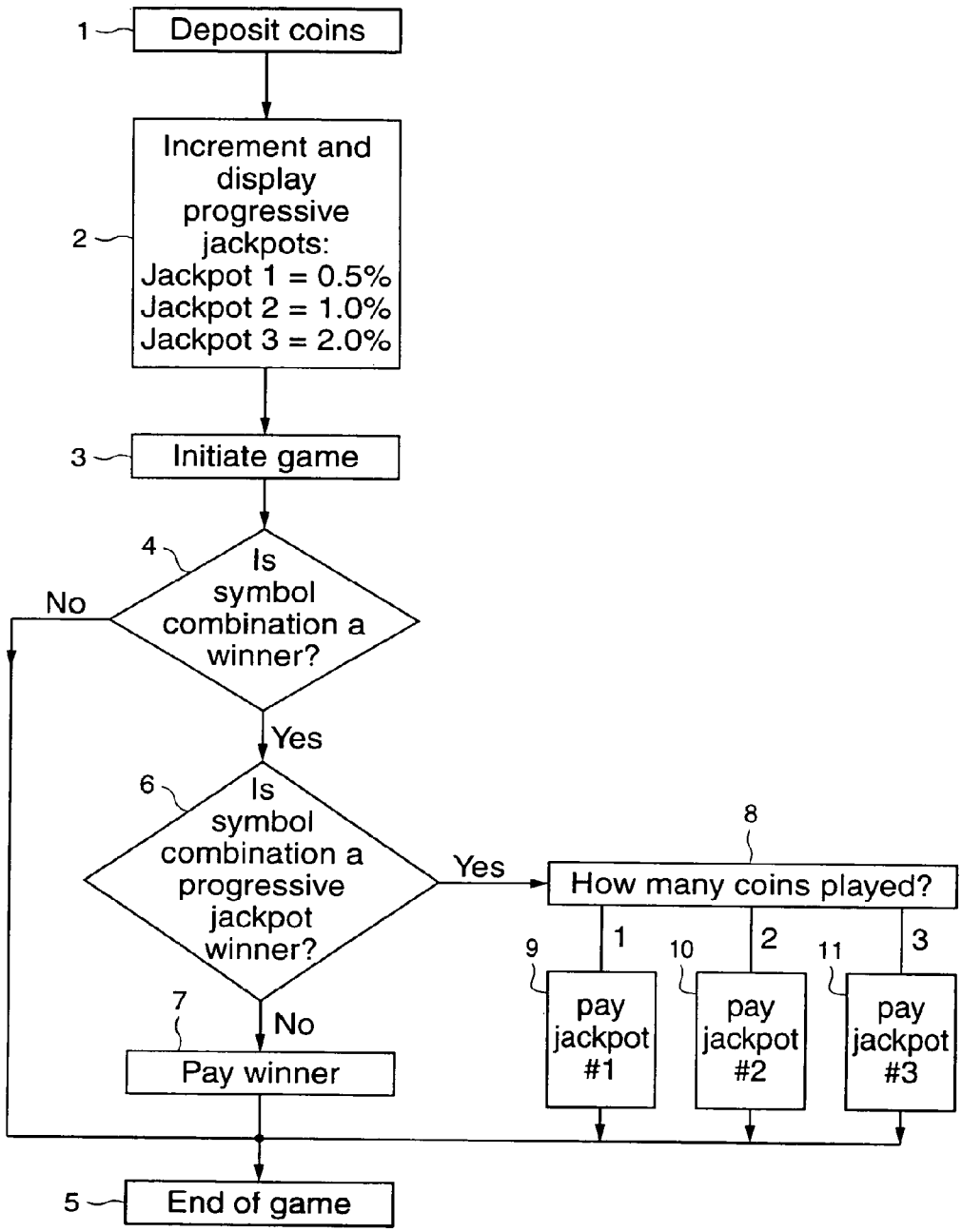
FIG. 2 is a flowchart illustrating the basic steps performed by the slot machine of FIG. 1.

FIG. 2 is a flowchart illustrating one possible method performed by the slot machine of FIG. 1. In step 1, coins or other monetary units are deposited. Any type of monetary credit may also be used. In the simplest embodiment, one coin enables the player to win the first progressive jackpot if a special combination of symbols is displayed by the slot machine 10. In conventional slot machines, depositing another coin simply doubles the winnings for any winning combination of symbols, not including the progressive jackpot. For example, two cherries displayed after betting a single coin may pay off three coins, and two cherries displayed with a two coin bet pays off six coins. In order to provide further incentive for the player to deposit two coins, a second jackpot is offered which is typically higher than the first jackpot. In one embodiment, with a two coin bet, if the player obtains the special symbol combination that pays the jackpot, the player will win the second jackpot plus the first jackpot. In another embodiment, the player will only win the second jackpot. As in conventional machines, the winning of a jackpot resets the jackpot amount to either zero or an initial predetermined amount.

This concept may be extended to additional jackpots corresponding to additional coins being played. Further, additional special symbol combinations may be designated that win the second jackpot but not the first jackpot, providing further incentive to bet additional coins.

Referring back to FIG. 2, after the player deposits the desired monetary amount, which will determine the possible jackpots that may be won upon achieving the special combination, the various jackpots are incremented according to the particular algorithm used. In the embodiment of FIG. 2, the progressive jackpot 1 is incremented by 0.5% of the amount bet, the jackpot 2 is incremented by 1% of the amount bet, and the jackpot 3 is incremented by 2% of the amount bet. Thus, jackpot 2 will typically be twice as large as jackpot 1, but jackpot 3 will be four times as large as jackpot 1, providing an added incentive to play three coins.

The jackpots are displayed to all the players, thus providing added incentive to play the machines over other machines which do not provide a jackpot or only provide a single jackpot.

In step 3, the player initiates the game by either pressing a button or pulling a handle. The reels rotate and stop at a predetermined combination, determined by a random number generator, as previously described.

In step 4, it is determined whether the symbol combination is a winner. If the symbol combination is not a winner, the game is over (step 5).

If the symbol combination is deemed a winner, the method proceeds to step 6, which determines whether the symbol combination is a progressive jackpot winner. If not, the method proceeds to step 7, whereby the player's winnings are determined by the pay-table ROM 26 (FIG. 1), and CPU 18 controls the payout mechanism 28 to pay the appropriate number of coins to the player or credit the player's account.

If the result of step 6 is that the symbol combination is a progressive jackpot winner, it is determined in step 8 how many coins (or credits) were bet by the player in order to determine which jackpot(s) to pay the player.

In one embodiment, a 3-coin play will pay the highest progressive jackpot. In another embodiment, a 3-coin play will only pay jackpot 3. In another embodiment, a 3-coin play will pay the total of all three jackpots. Similarly, in one embodiment, a 2-coin play will pay the higher of jackpot 1 or jackpot 2. In another embodiment, a 2-coin play will only pay jackpot 2. In an alternate embodiment, a 2-coin play will pay the sum of jackpots 1 and 2.

The control signals to pay the various jackpots are applied to the payout mechanism 28 (steps 9, 10, and 11) or, alternatively, an alarm is sounded and an attendant pays the jackpot(s) to the player.

Figure 3:
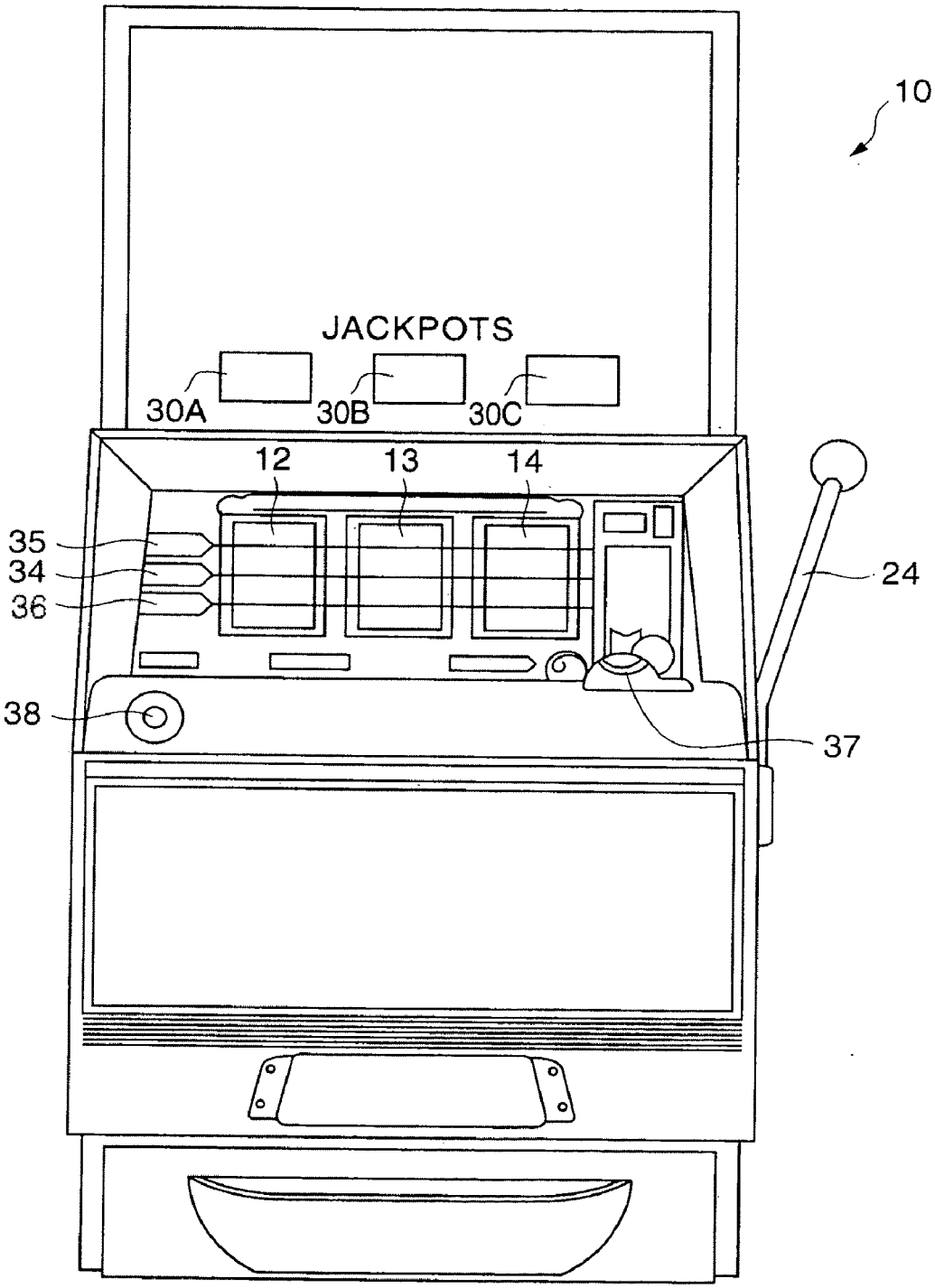
FIG. 3 illustrates one embodiment of a slot machine incorporating the invention and having a display for three different jackpots.

In one embodiment, the slot machine is a single payline machine, where only symbols 10 across payline 34 (FIGS. 1 and 3) are used for determining a winning combination. In another type of machine, there are three paylines 34, 35, and 36 (FIGS. 1 and 3). In such a device, each coin activates a corresponding payline so that a 3-coin play will activate all three paylines 34-36 as well as activate all the jackpots. In another embodiment, a three coin play activates the three paylines 34-36 and jackpot 1. An additional three coins doubles the awards as well as enables the winning of jackpot 2. An additional three coins triples the base awards and enables the winning ofjackpot 3.

In one embodiment of the game, jackpot 1 is only achievable with the special combination of symbols along the payline 34, jackpot 2 is only achievable across the payline 35, and jackpot 3 is only achievable across the payline 36. In other embodiments, a jackpot combination of symbols across any of the paylines 34-36 (assuming 3 coins have been bet) pays the player jackpot 3, whether by itself or in addition to jackpots 1 and 2, depending upon the particular embodiment.

FIG. 3 is a front view of a 3-payline slot machine 10 incorporating the functional units of FIG. 1. Jackpot displays 30A, 30B, and 30C display the three jackpots, respectively. A coin slot 37 and game play button 38 are also shown.

Figure 4:
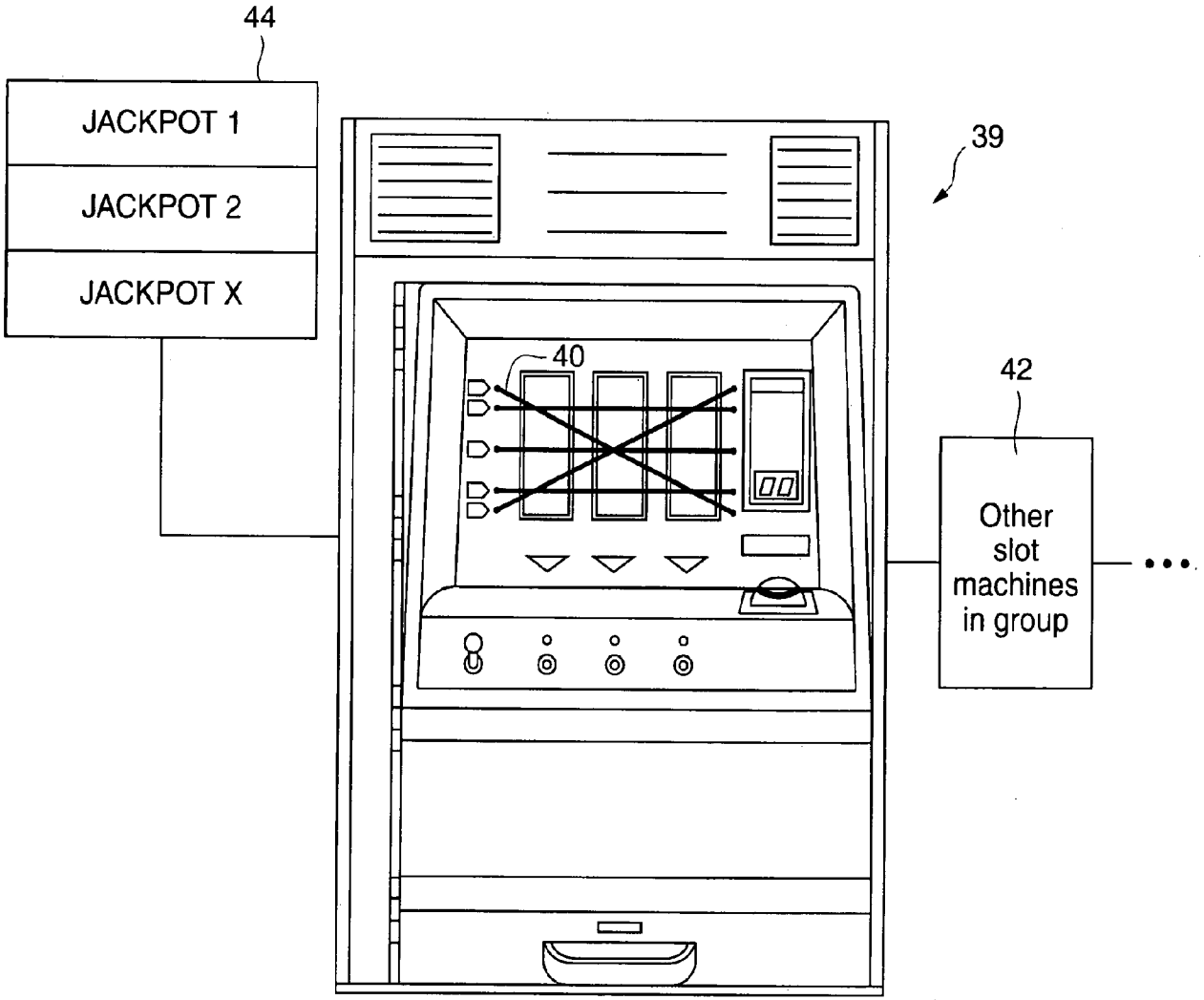
FIG. 4 is a front view of a slot machine having five paylines and an external display for displaying the different progressive jackpots.

The technique described with respect to FIGS. 1-3 may apply to either a single slot machine or a group of linked slot machines. FIG. 4 illustrates a slot machine 39 connected in a group of linked gaming machines, each machine having five possible ways of winning across horizontal and diagonal paylines 40.

FIG. 4 illustrates other slot machines 42 connected to slot machine 39. In such a group of linked gaming machines, it is often desirable to have a large display 44 external to the slot machines so that all players in the group may see the jackpots. A central processor polls all the machines in the group and calculates the jackpots.

Using a 5-payline machine, in one embodiment, the player inserts five coins to obtain the benefits of all 5 paylines and a chance at the first jackpot. The player must insert an additional five coins in order to double all award amounts and to be eligible for a second jackpot. The machine may require the player to insert a total of 15 coins to triple all award amounts and have the capability to win the third jackpot. Of course this concept may be extended to any number of jackpots.

Figure 5:
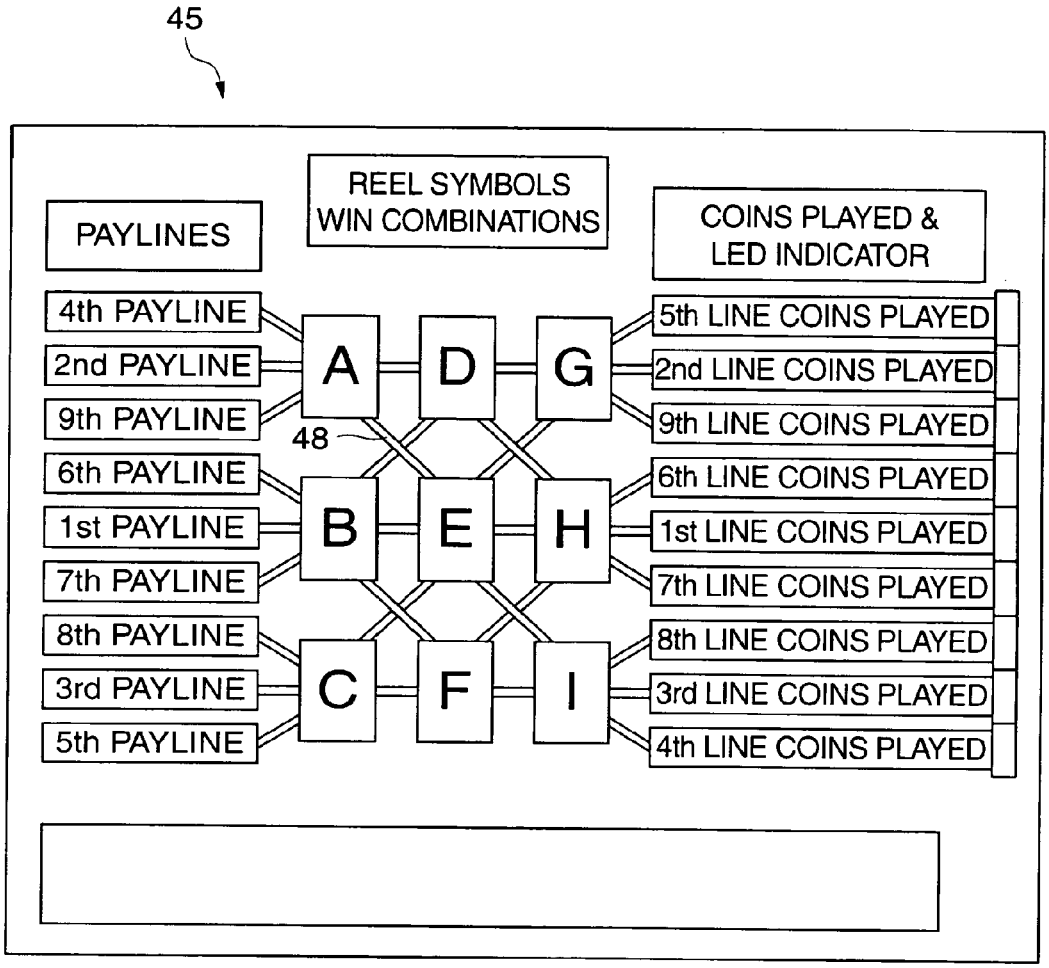
FIG. 5 illustrates the paylines for a 9-payline machine.

This concept may be applied to a 9-payline slot machine (FIG. 5), having a display 45. Such a machine is described in U.S. Pat. No. 5,807,172, incorporated herein by reference. With a 9-payline machine, each additional set of nine coins allows the player to win another progressive jackpot as well as multiply the standard awards. In FIG. 5, the activated paylines 48 are illuminated.

Figure 6:
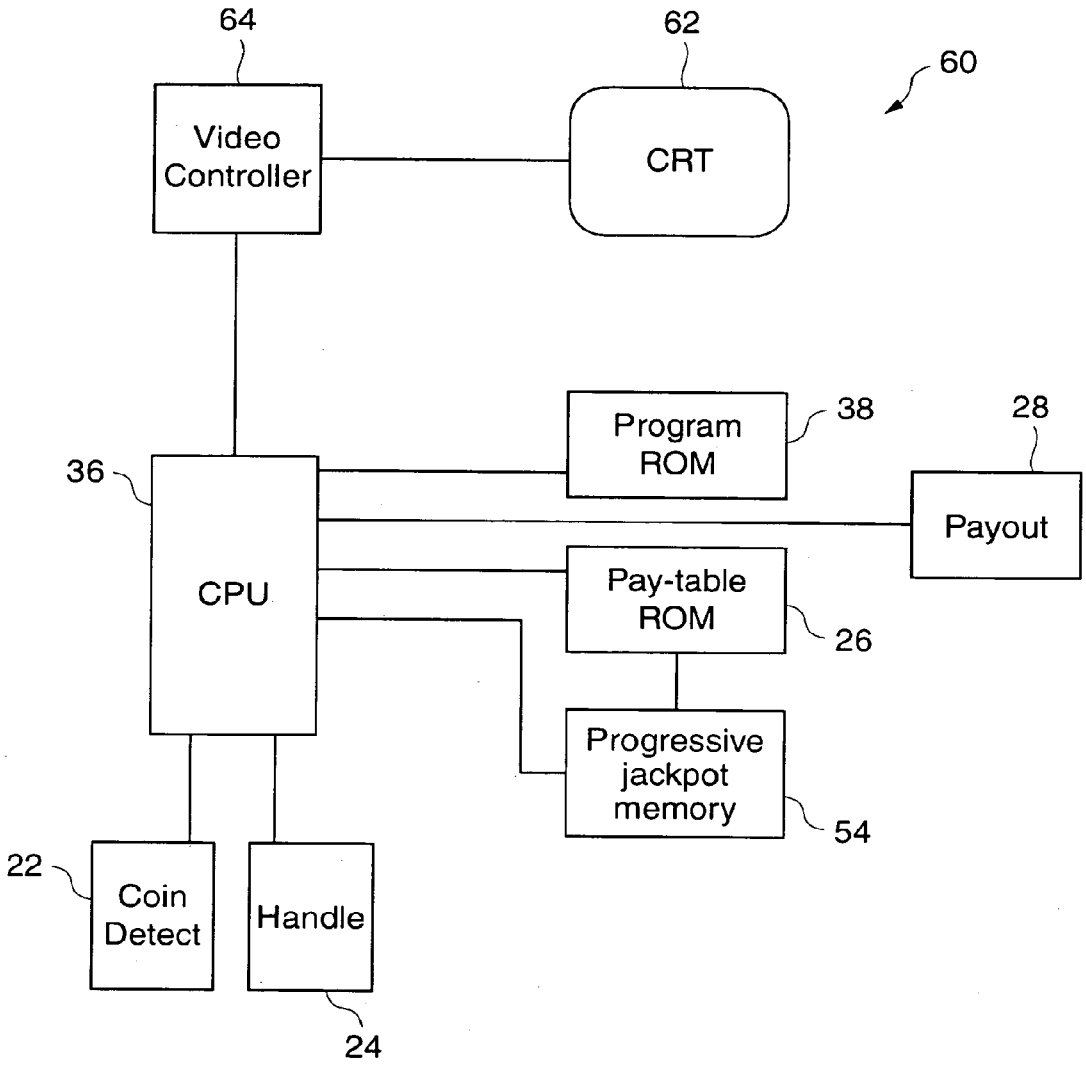
FIG. 6 illustrates the functional components of a video slot machine incorporating the present invention.

The above-described concept of multiple jackpots can also be applied to a video slot machine, which is essentially the same as that described with FIG. 1 except for the display portion. FIG. 6 illustrates the circuitry used in a video slot machine 60 which displays an animated version of rotating reels on a CRT 62. Other types of displays may also be used. A video controller 64 controls CRT 62 and receives commands from CPU 36. One skilled in the art would understand the requirements for video controller 64 and CPU 36, since these devices would be generic to a wide variety of slot machines. Functional units in FIGS. 1 and 6 labeled with the same numerals may be identical. The video controller 64 receives simple codes from CPU 36, then converts these codes into the pixel control signals used by CRT 62 to illustrate the rotating reels.

A progressive jackpot memory 54, which may use counters or simply store values calculated by CPU 36, identifies the jackpot amounts for the plurality of jackpots. The flowchart for this video slot machine is identical to that of FIG. 2. Video machines may be linked together as described with respect to FIG. 4.

Figure 7:
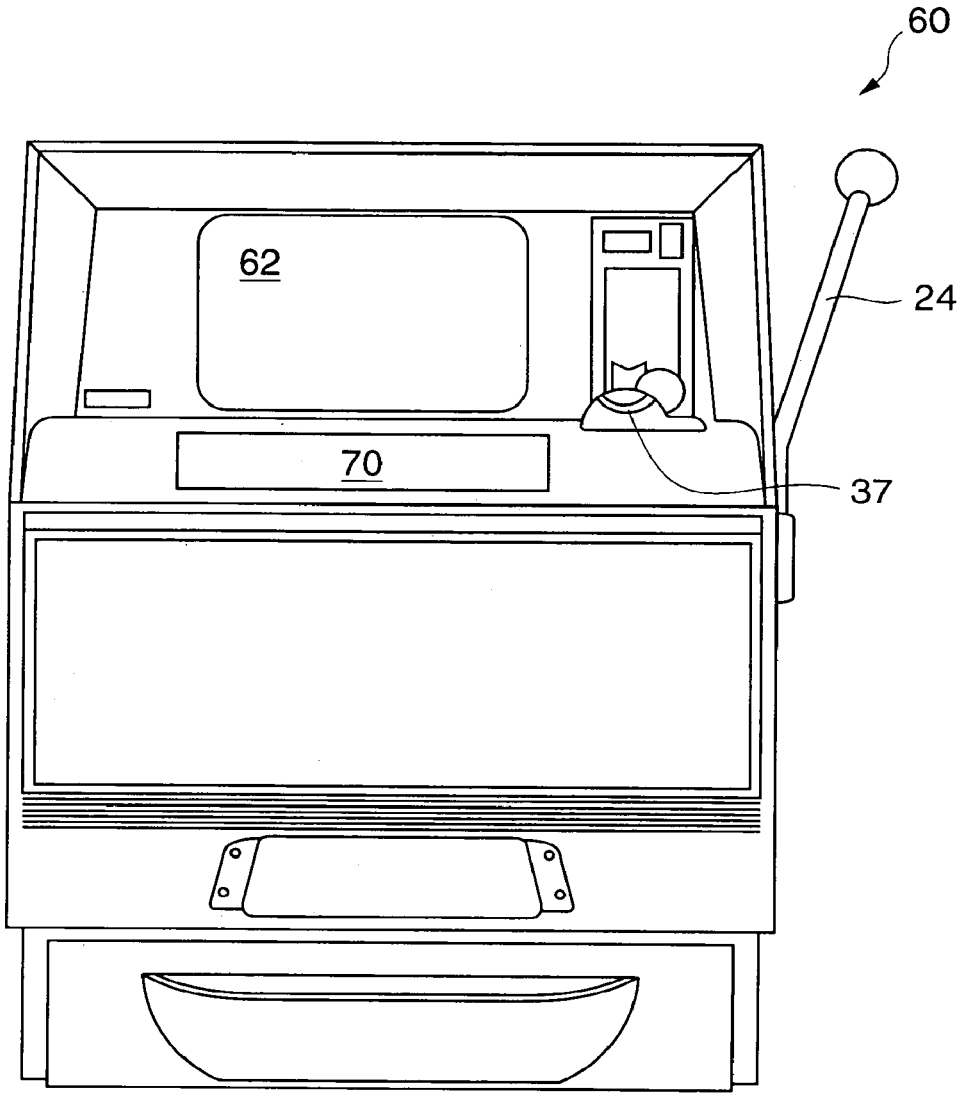
FIG. 7 is a front view of a video slot machine incorporating the present invention.

FIG. 7 is a front view of the video slot machine 60 that houses the functional units of FIG. 6. A control panel 70 provides a player interface for entering such information as the bet amount. A touch screen may also be used as a player input device.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A gaming machine for a gaming system providing a first progressive jackpot and a second progressive jackpot, the first progressive jackpot being funded by a first percentage of each wager placed in the gaming system and the second progressive jackpot being funded by a second percentage of each wager placed in the gaming system, the gaming machine including:

(a) a player interface system operative to enable a player to enter a wager and initiate a play of a game;

(b) a display device operative to display a result for the play of the game;

(c) a payout device operative to make payouts based on the result for the game play; and (d) a processing device associated with at least one memory device, the at least one memory device storing program instructions executable by the processing device to:

(i) in the event the result is a winning result which is not a winning progressive jackpot result, cause the payout device to make a payout based on a pay-table which correlates the result of the game play with payout amount, (ii) cause the player to be awarded the first progressive jackpot if the game result is a winning progressive jackpot result and if the wager was at least a first wager amount, and (iii) cause the player to be awarded the second progressive jackpot if the game result is the winning progressive jackpot result and if the wager was at least a second wager amount, the second wager amount being larger than the first wager amount.

2. The gaming system of claim 1 wherein the program instructions are executable to cause the player to be additionally awarded the first progressive jackpot if the wager was at least the second wager amount and the gaming result is the winning progressive jackpot result.

3. The gaming system of claim 1 wherein the winning progressive jackpot result is a result across a single payline defined through an array of reel symbol locations.

4. The gaming system of claim 3 wherein the winning progressive jackpot result is a result across any one of a number of paylines defined through an array of reel symbol locations.

5. A gaming system providing a first progressive jackpot and a second progressive jackpot available to be won across a plurality of gaming machines linked on a network, the system comprising:

a central processor programmed to communicate with the plurality of gaming machines and to calculate jackpots by contributing to a first progressive jackpot with a first percentage of a qualifying wager placed in the gaming system, and contributing to a second progressive jackpot with a second percentage of the qualifying wager;

wherein the gaming machines include:

(a) a player interface system operative to enable a player to enter a player's wager and initiate a play of a game;

(b) a display device operative to display a result for the play of the game;

(c) a payout device operative to make payouts based on the result for the game play; and (d) a processing device associated with at least one memory device, the at least one memory device storing program instructions executable by the processing device to:

(i) in the event the result is a winning result which is not a winning progressive jackpot result, cause the payout device to make a payout based on a pay-table which correlates the result of the game play with a payout amount, (ii) cause the player to be awarded the first progressive jackpot if the game result is a winning progressive jackpot result and if the player's wager was at least a first wager amount, and (iii) cause the player to be awarded the second progressive jackpot if the game result is the winning progressive jackpot result and if the player's wager was at least a second wager amount, the second wager amount being larger than the first wager amount.

6. The gaming system of claim 5, in which the processing device is further programmed for paying both the first and second progressive jackpots if the gaming result is the winning progressive jackpot result and if the player's wager was at least the second wager amount.

7. The gaming system of claim 5, wherein:

displaying the gaming result to the player further comprises displaying a number of game display elements, the number of game display elements having a plurality of possible states corresponding to different possible available outcomes of the gaming result, and wherein the plurality of possible states includes one or more winning states, and wherein the same number of winning states are made possible if the wager is of an amount qualifying for the second progressive jackpot as are made possible if the wager is of an amount qualifying for the first progressive jackpot but not for the second progressive jackpot.

8. The gaming system of claim 5 wherein the program instructions are executable to cause the player to be additionally awarded the first progressive jackpot if the player's wager was at least the second wager amount and the gaming result is the winning progressive jackpot result.

9. The gaming system of claim 5 wherein the winning progressive jackpot result is a result across a single payline defined through an array of reel symbol locations.

10. The gaming system of claim 9 wherein the winning progressive jackpot result is a result across any one of a number of paylines defined through an array of reel symbol locations.

11. A gaming method for a gaming system comprising one or more gaming machines, the gaming method comprising:

providing a first progressive jackpot and a second progressive jackpot for a gaming system, contributing to the first progressive jackpot with a first percentage of a qualifying wager placed through the gaming system, and contributing to the second progressive jackpot with a second percentage of a qualifying wager placed through the gaming system;

receiving a respective player wager in the gaming system;

after receiving the respective player wager, displaying a gaming result to a player;

paying the first progressive jackpot in response to the gaming result and the respective player wager qualifying for the first progressive jackpot prize;

paying the second progressive jackpot in response to the gaming result and the respective player wager qualifying for the second progressive jackpot prize;

awarding a non-jackpot prize if the gaming result is a winning result but the gaming result and respective player wager do not qualify for any jackpot prize;

wherein the gaming system comprises a plurality of linked gaming machines configured to participate in both the first and second progressive jackpots, and the first and the second progressive jackpots are common to all linked gaming machines so configured.

12. The method of claim 11, wherein displaying the gaming result to the player further comprises displaying a number of game display elements, the number of game display elements having a plurality of possible states corresponding to different possible available outcomes of the gaming result.

13. The method of claim 12, wherein the plurality of possible states includes one or more winning states, and wherein a higher number of winning states are made possible if the wager is of a type qualifying for the second progressive jackpot than are made possible if the wager is of a type qualifying for the first progressive jackpot but not for the second progressive jackpot.

14. The method of claim 12, wherein the number of game display elements includes a number of reel symbols displayed on a video display showing a video version of rotating reels.

15. The method of claim 14, wherein the winning states include winning patterns of reel symbols present along a defined set of paylines through the number of reel symbols.

16. The method of claim 12, wherein the plurality of possible states includes one or more winning states, and wherein the same number of winning states are made possible if the wager is of a type qualifying for the second progressive jackpot as are made possible if the wager is of a type qualifying for the first progressive jackpot but not for the second progressive jackpot.

* * * * *